United States Patent [19]

Anzenberger, Sr.

[11] Patent Number: 4,461,713

[45] Date of Patent: Jul. 24, 1984

[54] ACID-RESISTANT PHOSPHATE ESTER FUNCTIONAL FLUIDS

[75] Inventor: Joseph F. Anzenberger, Sr., New City, N.Y.

[73] Assignee: Stauffer Chemical Company, Westport, Conn.

[21] Appl. No.: 481,436

[22] Filed: Apr. 1, 1983

[51] Int. Cl.[3] ..... C10M 3/40; C10M 3/26

[52] U.S. Cl. ..... 252/49.9; 252/78.5; 252/50; 252/52 R

[58] Field of Search ..... 252/49.9, 78.5, 50, 252/52 R

[56] References Cited

U.S. PATENT DOCUMENTS

| | | | |
|---|---|---|---|
| 3,071,549 | 1/1963 | Shark | 252/78.5 |
| 3,649,721 | 3/1972 | Burrows et al. | 252/78.5 |
| 3,718,596 | 2/1973 | Richard, Jr. | 252/49.8 |
| 3,723,320 | 3/1973 | Herber et al. | 252/49.9 |
| 3,923,672 | 12/1975 | Durr et al. | 252/49.9 |
| 3,926,823 | 12/1975 | Durr et al. | 252/49.9 |
| 3,957,668 | 5/1976 | Sheratte | 252/78.5 |
| 4,169,800 | 10/1979 | Dourchis | 252/49.9 |

*Primary Examiner*—Jacqueline V. Howard
*Attorney, Agent, or Firm*—Roger S. Benjamin

[57] ABSTRACT

An acid resistant phosphate ester functional fluid comprises phosphate ester basestock and an additive composition comprising: (1) N-alkyl-2-pyrrolidone, (2) epoxide, and (3) triazole. The functional fluid has utility for lubricating machinery. The additive composition may be prepared separately and used for imparting acid resistance to phosphate esters.

21 Claims, 1 Drawing Figure

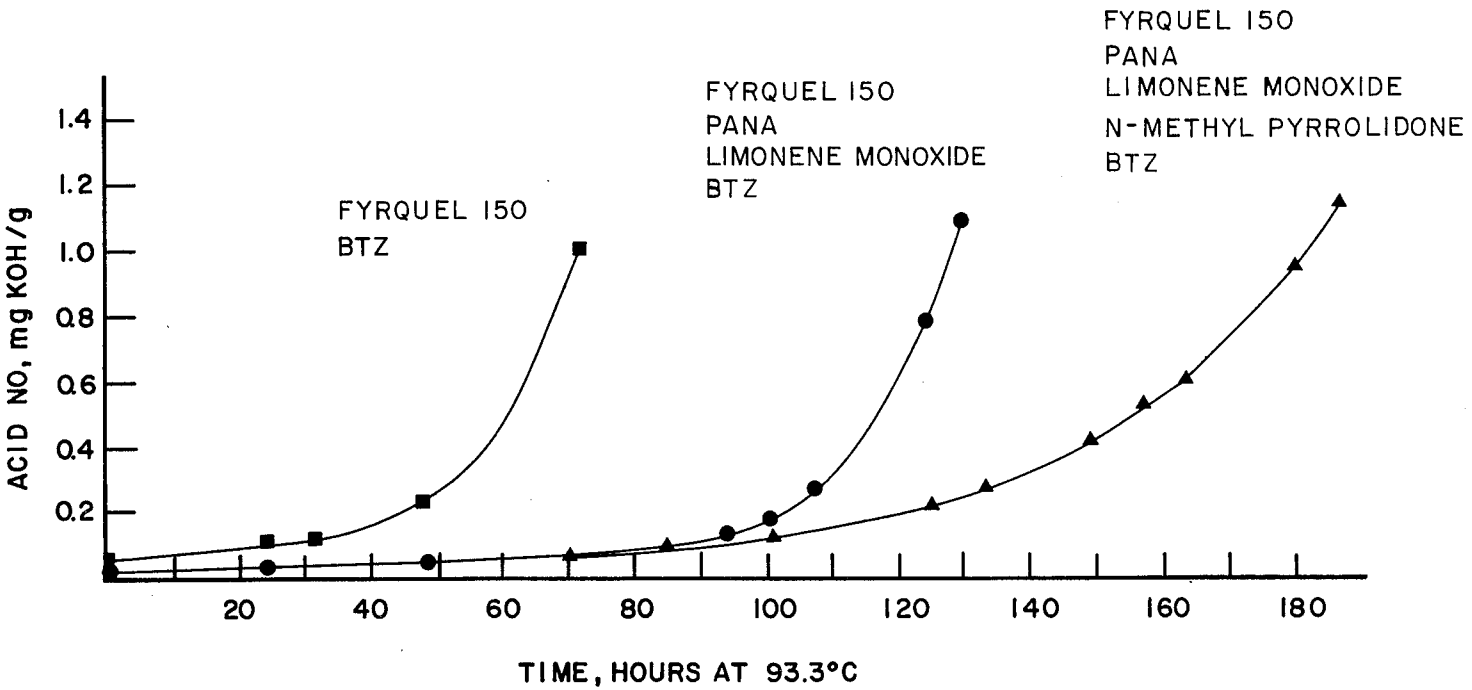
FYRQUEL 150
PANA
LIMONENE MONOXIDE
N-METHYL PYRROLIDONE
BTZ
FYRQUEL 150
PANA
LIMONENE MONOXIDE
BTZ
FYRQUEL 150
BTZ
ACID NO, mg KOH/g
1.4
1.2
1.0
0.8
0.6
0.4
0.2
20
40
60
80
100
120
140
160
180
TIME, HOURS AT 93.3°C

ACID-RESISTANT PHOSPHATE ESTER FUNCTIONAL FLUIDS

BACKGROUND OF THE INVENTION

Phosphate esters have utility as basestocks in functional fluid applications such as lubricants and hydraulic fluids. These ester basestocks are particularly desirable where fire retardance and high temperature stability characteristics are required.

Deterioration of phosphate esters is evidenced by increasing acidity, presumably from hydrolytic/oxidative degradation. Eventually the acidity of the phosphate ester will increase to the point where it is corrosive for its intended use.

It is known to use chemical additives to enhance the resistance of phosphate esters to acid formation. U.S. Pat. Nos. 3,718,596, 3,723,320, and 3,649,721 describe the use of epoxides for phosphate ester stabilization. U.S. Pat. No. 4,169,800 recites the use of benzotriazole as a corrosion inhibitor. U.S. Pat. No. 3,071,549 recites various amines as oxidation inhibitors.

A number of different compounds have been used to control the acid formation in phosphate ester functional fluids. However, for each acid-control compound in use there are disadvantages such as short effective life or deleterious byproduct formation.

It is desirable to develop acid-resistant additives for phosphate esters which are effective at low concentrations, have long life under adverse conditions, permit only gradual acid buildup, and do not form unwanted byproducts.

SUMMARY OF THE INVENTION

This invention is an acid resistant phosphate ester functional fluid. This functional fluid comprises a phosphate ester basestock mixed with an acid resistant additive composition containing (1) N-alkyl-2-pyrrolidone (2) epoxide, and (3) triazole. This invention is also an additive composition suitable for addition to a phosphate ester basestock. Moreover, this invention is an improved method of lubricating machinery which comprises contacting the moving parts of a machine with phosphate ester lubricant containing an acid resistant additive according to this invention.

DESCRIPTION OF THE DRAWING

The drawing is a graph depicting the development of acidity in phosphate ester fluids as a function of time.

DETAILED DESCRIPTION OF THE INVENTION

This invention is an acid resistant phosphate ester functional fluid. The superior acid resistant properties of the fluid of this invention arise from the combination of a phosphate ester basestock and an acid resistant additive composition comprising an acid retardant amount of ingredients consisting essentially of (1) N-alkyl-2-pyrrolidone, (2) epoxide, and (3) triazole.

The three essential ingredients of the additive composition are mutually soluble and are soluble in the phosphate ester basestock at the concentrations employed in the invention. It is a discovery of this invention that a combination of three ingredients is particularly effective in delaying acid formation. The effectiveness of the additive combination was unexpectedly superior to the known acid resistance properties of the individual composition ingredients or their subcombinations. Moreover, the acid retardance of the additive composition of the invention is effective in reducing the rate at which the phosphate ester develops acidity, particularly at higher acid levels (viz., TAN above 0.07 mg.KOH/g.). This slowing of the rate of acid formation is a particularly desirable aspect of the invention because it permits the user of the functional fluid more time to take corrective action.

The N-alkyl-2-pyrrolidone essential ingredient is selected from lower alkyl pyrrolidones wherein the alkyl group is not more than 6 carbon atoms. The N-alkyl-2-pyrrolidones such as N-propyl-2-pyrrolidone, N-ethyl-2-pyrrolidone, and N-methyl-2-pyrrolidone are considered preferred. Particularly preferred is N-methyl-2-pyrrolidone because of effectiveness, cost and availability.

The epoxide essential ingredient comprises epoxy compounds known to have utility for scavenging acid in functional fluid applications. Suitable epoxy compounds include epoxidized oils and fats, epoxy esters, alkyl epoxides, cycloalkyl epoxides, alkaryl epoxides, monoepoxynorbornyl compounds, limonene monoxide, 3,4-epoxycycloalkyl-3,4-epoxycycloalkyl carboxylates, glycidyl methyl ether, isobutylene oxide, butadiene monoxide, styrene oxide, polyether condensation products of ethylene or propylene oxide, and mixtures thereof. A particularly preferred epoxide ingredient is limonene monoxide because it does not tend to form residues and is highly compatible with the phosphate ester basestock.

The triazole essential ingredient is selected from triazole compounds conventionally known to have utility as corrosion inhibitors in functional fluids. Suitable triazoles include 2-mercaptobenzothiazole, tolyltriazole, benzotriazole, and mixtures thereof.

In addition to the above mentioned essential ingredients there are many other conventional additives which may be added to the functional fluid at the option of the formulator. Other additives may functionally include dyes, pour point depressants, antioxidants, antifoam agents, viscosity index improvers, and lubricity agents.

The phosphate ester basestock for the functional fluid is a liquid phosphate ester represented by the formula:

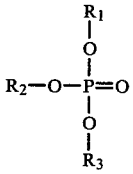

wherein $R_1$, $R_2$, and $R_3$ are the same or different and are selected from the group consisting of alkyl, aryl, alkaryl, aralkyl, and cycloalkyl. Examples of suitable phosphate esters are butyl/phenyl phosphates, cresyl/phenyl phosphates, 2-ethylhexyl/phenyl phosphates, octyl/phenyl phosphates, isodecyl/phenyl phosphates, phenyl phosphates, cresyl phosphates, xylyl phosphates, xylyl/phenyl phosphates, xylyl/cresyl phosphates, isopropylphenyl/phenyl phosphates, secondarybutylphenyl/phenyl phosphates, tertiarybutylphenyl/phenyl phosphates, and mixtures thereof. Particularly preferred for thermal stability, and uniformity are basestocks containing mixtures of monotertiarybutylphenyl/diphenyl phosphate and ditertiarybutylphenyl/phenyl phosphate.

The concentration of acid-resistant additive composition in the phosphate ester functional fluid is at least about 0.005 weight percent and preferably at least 0.01 weight percent. Moreover, no individual essential ingredient of the additive composition should comprise more than about 0.5 weight percent, and preferably not more than 0.10 weight percent of the functional fluid. In addition, the summed weight of the three essential ingredients of the invention should comprise less than one percent, and preferably less than 0.5 weight percent of the functional fluid.

The concentration of acid-resistant additive in the functional fluid is not critical and may be adjusted to optimum levels by the user. An "acid-reducing effective amount" of additive composition may be determined by taking an aliquot sample of fluid and determining its acidity after a selected time period in a suitable standard test such as the ASTM D 974-neutralization number by color indicator titration method. A generally desirable acidity is less than about 0.05 mg. KOH/g.

The proportions of each of the essential ingredients in the acid-resistant additive composition is not critical provided its presence is in an amount effective to coact with the other essential ingredients to retard acidic degradation of the functional fluid. The optimum proportions may be determined by analysis of aliquot samples using the test procedure set out in the preceding paragraph. Typically, the weight ratio of N-alkyl-2-pyrrolidone to epoxide is from about 10:1 to about 1:10; the weight ratio of N-alkyl pyrrolidone to triazole is from about 10:1 to about 1:10, and the weight ratio of epoxide to triazole is from about 10:1 to about 1:10.

The preferred practice of this invention is to use as basestock a liquid consisting essentially of phosphate ester, preferably triaryl phosphate. However, if desired the phosphate ester basestock may be mixed with other functional fluids. Examples of functional fluids which may optionally be mixed with the phosphate ester to form the basestock are silicate esters, silicones, carboxylic acid esters, polyalphaolefins, paraffinic oils, naphthenic oils, alkyl benzenes, alkylene oxide oligomers, and mixtures thereof. Such non-phosphate ester functional fluids added to the basestock should not exceed about 40 weight percent of the basestock.

This invention is also an acid resistant additive composition suitable for formulation with a phosphate ester basestock. The additive composition is prepared by mixing as essential ingredients: (1) N-methyl-2-pyrrolidone, (2) epoxide, and (3) triazole. The relative proportions of the essential ingredients are those previously set out in this section of the description. If desired the additive composition may be supplemented with optional ingredients such as other stabilizers, dyes, or diluents.

The additive composition is used by dispersing it in the phosphate ester basestock to obtain a uniform mixture. The mixing is easily accomplished since the composition is completely soluble in the phosphate ester at concentrations of not more than one percent (based on the weight of the functional fluid). The additive composition is storage stable but should preferably be kept in sealed containers to avoid contamination by water and exposure to air.

The acid resistant functional fluid of the invention may be employed in a method of lubricating machinery. Lubrication of machinery is achieved by contacting the moving parts of a machine with the lubricant composition. The lubricant may be contacted with the machine parts by such conventional means as spraying, dipping, or padding. This method of lubrication finds particular application in high temperature, long term applications such as electric power generating turbines.

The acid resistant functional fluid of the invention may also be employed in a method for the hydraulic transmission of power or the hydraulic damping of motion (as in a shock absorber). The functional fluids of the invention are inserted in hydraulic apparatus including hydraulic reservoirs and lines and constitute an improved system of transmitting power with a fluid having flame retardant and acid resistant properties.

EXAMPLE

This Example illustrates the accelerated degradation of phosphate ester functional fluids containing different types and proportions of additives.

APPARATUS AND METHOD

A sample of tertiarybutylphenyl/phenyl phosphate (about 800 grams) was introduced into a three neck one-liter glass round bottom flask. The flask was equipped with temperature control means, heating mantle, stirrer, and an outlet equipped with a cold water cooled condenser (to prevent water loss). A clean copper coupon and 8–10 grams of water were added to the fluid in the flask to promote hydrolysis. The flask contents were stirred and heated at 93.3° C. and the acid number of the phosphate ester fluid measured on a 10 ml. aliquot sample withdrawn at selected time intervals. The acidity of the fluid was measured by the ASTM D 974 test method (neutralization number by color indicator titration test-milligrams KOH per gram of phosphate ester fluid).

The phosphate ester functional fluid composition and acid titration test results are shown in the following Table:

TABLE

| SAMPLE | NMP[1] | LIMOX[2] | BTZ[3] | PANA[4] | HRS | TAN[5] | EST.[12] 100 HR. TAN |
|---|---|---|---|---|---|---|---|
| A[10] | .05 | — | — | — | 0 | .012 | 8.45 |
| | | | | | 24 | .068 | |
| | | | | | 48 | .293 | |
| | | | | | 65 | .925 | |
| B[10] | .022 | — | — | — | 0 | .026 | 3.6 |
| | | | | | 24 | .026 | |
| | | | | | 48 | .161 | |
| | | | | | 52 | .224 | |
| | | | | | 76 | .870 | |
| C[6] | .05 | — | — | — | 0 | .01 | .21 |
| | | | | | 24 | .01 | |
| | | | | | 48 | .03 | |
| | | | | | 72 | .06 | |

TABLE-continued

| SAMPLE | NMP[1] | LIMOX[2] | BTZ[3] | PANA[4] | HRS | TAN[5] | EST.[12] 100 HR. TAN |
|---|---|---|---|---|---|---|---|
| | | | | | 96 | .18 | |
| | | | | | 104 | .25 | |
| | | | | | 168 | 1.67 | |
| D[7,10] | — | — | .02 | — | 0 | .020 | 1.25 |
| | | | | | 24 | .053 | |
| | | | | | 42 | .068 | |
| | | | | | 48 | .094 | |
| | | | | | 66 | .232 | |
| | | | | | 72 | .281 | |
| | | | | | 96 | 1.070 | |
| E[10] | — | — | .02 | — | 0 | .029 | 3.72 |
| | | | | | 24 | .103 | |
| | | | | | 31 | .105 | |
| | | | | | 48 | .234 | |
| | | | | | 72 | 1.014 | |
| F[10] | — | .06 | .02 | .05 | 0 | .031 | .35 |
| | | | | | 24 | .029 | |
| | | | | | 48 | .034 | |
| | | | | | 72 | .084 | |
| | | | | | 96 | .247 | |
| | | | | | 102 | .425 | |
| | | | | | 119 | 1.050 | |
| G[10] | — | .06 | .02 | .05 | 0 | .027 | .184 |
| | | | | | 24 | .027 | |
| | | | | | 48 | .039 | |
| | | | | | 94 | .135 | |
| | | | | | 100 | .175 | |
| | | | | | 107 | .274 | |
| | | | | | 124 | .798 | |
| | | | | | 129 | 1.088 | |
| H[8] | .02 | .06 | .02 | — | 0 | .028 | .084 |
| | | | | | 72 | .031 | |
| | | | | | 96 | .079 | |
| | | | | | 120 | .164 | |
| | | | | | 140 | .374 | |
| | | | | | 146 | .476 | |
| | | | | | 164 | 1.076 | |
| I[8] | .02 | .06 | .02 | .05 | 0 | .029 | .055 |
| | | | | | 24 | .029 | |
| | | | | | 48 | .041 | |
| | | | | | 72 | .041 | |
| | | | | | 96 | .040 | |
| | | | | | 126 | .196 | |
| | | | | | 134 | .211 | |
| | | | | | 150 | .453 | |
| | | | | | 158 | .710 | |
| | | | | | 174 | 1.371 | |
| J[10] | .039 | .06 | .02 | .05 | 0 | .034 | .220 |
| | | | | | 24 | .036 | |
| | | | | | 48 | .036 | |
| | | | | | 72 | .068 | |
| | | | | | 96 | .182 | |
| | | | | | 104 | .277 | |
| | | | | | 108 | .318 | |
| | | | | | 124 | .755 | |
| | | | | | 127 | .924 | |
| | | | | | 129 | .994 | |
| K[6,10] | .01 | .06 | .02 | .05 | 0 | .06 | .15 |
| | | | | | 22 | .06 | |
| | | | | | 94 | .12 | |
| | | | | | 118 | .30 | |
| | | | | | 150 | .94 | |
| | | | | | 166 | 1.74 | |
| L[10] | .02 | .06 | .02 | .05 | 0 | .04 | .131 |
| | | | | | 24 | .04 | |
| | | | | | 48 | .05 | |
| | | | | | 71 | .06 | |
| | | | | | 78 | .08 | |
| | | | | | 85 | .10 | |
| | | | | | 101 | .13 | |
| | | | | | 109 | .16 | |
| | | | | | 125 | .22 | |
| | | | | | 133 | .28 | |
| | | | | | 149 | .43 | |
| | | | | | 157 | .54 | |
| | | | | | 163 | .60 | |
| | | | | | 180 | .95 | |
| | | | | | 187 | 1.15 | |
| M[11] | .02 | .05[9] | .02 | .05 | 0 | .037 | .04 |

TABLE-continued

| SAMPLE | NMP[1] | LIMOX[2] | BTZ[3] | PANA[4] | HRS | TAN[5] | EST.[12] 100 HR. TAN |
|---|---|---|---|---|---|---|---|
| | | | | | 24 | .035 | |
| | | | | | 48 | .035 | |
| | | | | | 72 | .035 | |
| | | | | | 96 | .054 | |
| | | | | | 120 | .133 | |
| | | | | | 127 | .198 | |
| | | | | | 132 | .304 | |
| | | | | | 150 | .851 | |
| | | | | | 155 | 1.022 | |
| N[11] | .04 | .05[9] | .02 | .05 | 0 | .026 | .143 |
| | | | | | 24 | .036 | |
| | | | | | 40 | .040 | |
| | | | | | 72 | .045 | |
| | | | | | 96 | .103 | |
| | | | | | 104 | .169 | |
| | | | | | 126 | .43 | |
| | | | | | 174 | 1.36 | |
| O[11] | .08 | .05[9] | .02 | .05 | 0 | .023 | .24 |
| | | | | | 24 | .026 | |
| | | | | | 40 | .029 | |
| | | | | | 72 | .049 | |
| | | | | | 96 | .168 | |
| | | | | | 104 | .365 | |
| | | | | | 126 | 1.15 | |

TABLE NOTES:
[1]NMP — N—methyl-2-pyrrolidone
[2]LIMOX — limonene monoxide
[3]BTZ — benzotriazole
[4]PANA — phenyl alphanaphthylamine
[5]TAN — titratable total acid number determined by ASTM D-974
[6]suspected water loss for this sample
[7]fluid treated with activated charcoal before test
[8]Fyrquel ® 220 tertiary butylphenyl/phenylphosphate fluid, viscosity 42–50 cSt at 37.8° C., product of Stauffer Chemical Company
[9]3,4-epoxycycloalkyl-3,4-epoxycycloalkyl carboxylate substituted for limonene monoxide as epoxide ingredient
[10]Fyrquel ® 150 tertiarybutylphenyl/phenylphosphate fluid, viscosity 29–37 cSt at 37.8° C., product of Stauffer Chemical Company
[11]Fyrquel ® GT functional fluid is Fryquel 150 commercially prepared with stabilizer additives
[12]100 hr. estimate calculated by least squares regression of TAN values over about 0.07 vs. time as: $\log_{10}(TAN \cdot 100) = m(\text{time, hrs.}) + b$

TEST RESULTS

Samples A, B, C, D, E, F, and G were control experiments lacking one or more essential ingredients of the acid resisting composition of the invention. Samples H, I, J, K, L, M, N and O are embodiments of the invention.

Ranked in order of increasing estimated titratable acid number at 100 hours (TAN by ASTM D-974) the Table displays the following:

| Est. 100 Hr. TAN | Sample | Type |
|---|---|---|
| .040 | M | Embodiment of Invention |
| .055 | I | Embodiment of Invention |
| .084 | H | Embodiment of Invention |
| .131 | L | Embodiment of Invention |
| .143 | N | Embodiment of Invention |
| .150 | K | Embodiment of Invention |
| .184 | G | Control Experiment |
| .210 | C | Control Experiment |
| .220 | J | Embodiment of Invention |
| .240 | O | Embodiment of Invention |
| .350 | F | Control Experiment |
| 1.250 | D | Control Experiment |
| 3.600 | B | Control Experiment |
| 3.720 | E | Control Experiment |
| 8.450 | A | Control Experiment |
| | | Control Experiment |

The ranking of samples illustrates that samples containing the three essential ingredients of the embodiment of the invention have generally lower acid numbers than the control experiments absent one or more essential ingredients.

EXPLANATION OF THE DRAWING

The FIGURE displays three curves based on data from samples E, G, and L given in the Example. The curve drawn through the square symbols (Sample E—Fyrquel ®150, BTZ) shows relatively rapid development of acidity. The middle curve drawn through the circle symbols (Sample G—Fyrquel ®150, PANA, limonene monoxide, BTZ) shows somewhat improved time delay of development of acidity compared to Sample E. The curve drawn through the triangle symbols (Sample L—Fyrquel ®150, PANA, limonene monoxide, N-methyl-2-pyrrolidone, BTZ) corresponds to the practice of the invention and shows the greatest delay of acid formation with respect to time. It is also notable that the slope (TAN/time) of the rightmost Sample L curve at high acid values is less than the slope of sample curves E or G. Sample L acid formation not only is delayed but its buildup rate is more gradual than that obtained for control experiment samples.

While the present invention has been described with reference to particular embodiments, it should be understood that such embodiments are not intended to limit the scope of the claimed invention.

I claim:

1. A phosphate ester functional fluid containing an acid-resistant additive composition, wherein said composition comprises as essential ingredients: (1) N-alkyl-2-pyrrolidone, (2) epoxide, and (3) triazole.

2. The functional fluid of claim 1 wherein the N-alkyl-2-pyrrolidone is N-methyl-2-pyrrolidone.

3. The functional fluid of claim 1 wherein the epoxide is limonene monoxide.

4. The functional fluid of claim 1 wherein the triazole is selected from the group consisting of benzotriazole, 2-mercaptobenzothiazole, and tolyltriazole.

5. The functional fluid of claim 1 wherein the weight ratio of N-alkyl-2-pyrrolidone to epoxide is from about 10:1 to about 1:10, the weight ratio of N-alkyl pyrrolidone to triazole is from about 10:1 to about 1:10; and the weight ratio of epoxide to triazole is from about 10:1 to about 1:10.

6. The functional fluid of claim 1 wherein each ingredient has a concentration of not more than 0.5 weight percent, and the summed weight of the three ingredients is less than 1 weight percent of the functional fluid.

7. The functional fluid of claim 1 wherein the phosphate ester is selected from the group consisting of butyl/phenyl phosphates, cresyl/phenyl phosphates, 2-ethylhexyl/phenyl phosphates, octyl/phenyl phosphates, isodecyl/phenyl phosphates, phenyl phosphates, cresyl phosphates, xylyl phosphates, xylyl/phenyl phosphates, xylyl/cresyl phosphates, isopropylphenyl/phenyl phosphates, secondarybutylphenyl/phenyl phosphates, tertiarybutylphenyl/phenyl phosphates, and mixtures thereof.

8. The functional fluid of claim 7 wherein the phosphate ester is a mixture comprising a tertiarybutylphenyl/diphenyl phosphate and ditertiarybutylphenyl/phenyl phosphate.

9. A composition for resisting acid formation of phosphate ester functional fluids, said composition consisting essentially of (1) N-alkyl-2-pyrrolidone, (2) epoxide, and (3) triazole.

10. The composition of claim 9 wherein the epoxide is limonene monoxide.

11. The composition of claim 9 wherein the N-alkyl-2-pyrrolidone is N-methyl-2-pyrrolidone.

12. The composition of claim 9 wherein the triazole is selected from the group consisting of benzotriazole, 2-mercaptobenzothiazole, and tolyltriazole.

13. The composition of claim 9 wherein the weight ratio of N-alkyl-2-pyrrolidone to epoxide is from about 10:1 to about 1:10; the weight ratio of N-alkyl-2-pyrrolidone to epoxide is from about 10:1 to about 1:10 and the weight ratio of epoxide is triazole is from about 10:1 to about 1:10.

14. A method of lubricating machinery wherein the improvement comprises contacting the moving parts of said machinery with the phosphate ester functional fluid comprising a phosphate ester basestock and an acid resistant additive composition consisting essentially of (1) N-alkyl-2-pyrrolidone, (2) epoxide, and (3) triazole.

15. The method of claim 14 wherein the N-alkyl-2-pyrrolidone is N-methyl-2-pyrrolidone.

16. The method of claim 14 wherein the epoxide is limonene monoxide.

17. The method of claim 14 wherein the triazole is selected from the group consisting of benzotriazole, 2-mercaptobenzothiazole, and tolyltriazole.

18. The method of claim 14 wherein the weight ratio of N-alkyl-2-pyrrolidone to epoxide is from about 10:1 to about 1:10; the weight ratio of N-alkyl-2-pyrrolidone to triazole is from about 10:1 to about 1:10; and the weight ratio of epoxide to triazole is from about 10:1 to about 1:10.

19. The method of claim 14 wherein each ingredient has a concentration of not more than 0.5 weight percent, and the summed weight of the three ingredients is less than 1 weight percent of the functional fluid.

20. The method of claim 14 wherein the phosphate ester is selected from the group consisting of butyl/phenyl phosphates, cresyl/phenyl phosphates, 2-ethylhexyl/phenyl phosphates, octyl/phenyl phosphates, isodecyl/phenyl phosphates, phenyl phosphates, cresyl phosphates, xylyl phosphates, xylyl/phenyl phosphates, xylyl/cresyl phosphates, isopropylphenyl/phenyl phosphates, secondarybutylphenyl/phenyl phosphates, tertiarybutylphenyl/phenyl phosphates, and mixtures thereof.

21. A method of hydraulically transmitting power using a hydraulic fluid in hydraulic apparatus, wherein the improvement comprises using a hydraulic fluid a phosphate ester functional fluid containing an acid-resistant additive composition, wherein said composition comprises as essential ingredients: (1) N-alkyl-2-pyrrolidone, (2) epoxide, and (3) triazole.

* * * * *

UNITED STATES PATENT AND TRADEMARK OFFICE

CERTIFICATE OF CORRECTION

PATENT NO. : 4,461,713

DATED : July 24, 1984

INVENTOR(S) : Joseph F. Anzenberger, Sr.

It is certified that error appears in the above—identified patent and that said Letters Patent is hereby corrected as shown below:

Col. 7, line 64, the last recitation "Control Experiment" in the Table should be deleted; and Col. 10, line 3, "epoxide is triazole" should read -- epoxide to triazole --.

Signed and Sealed this

*Twenty-sixth* Day of *February 1985*

[SEAL]

*Attest:*

DONALD J. QUIGG

*Attesting Officer* *Acting Commissioner of Patents and Trademarks*